US010705454B2

(12) United States Patent
Yasuda et al.

(10) Patent No.: US 10,705,454 B2
(45) Date of Patent: Jul. 7, 2020

(54) TONER SUPPLY DEVICE WITH MOVABLE TONER BOTTLE

(71) Applicant: KONICA MINOLTA, INC., Chiyoda-ku, Tokyo (JP)

(72) Inventors: Keiko Yasuda, Toyohashi (JP); Hideaki Ikeda, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/376,539

(22) Filed: Apr. 5, 2019

(65) Prior Publication Data

US 2019/0339633 A1 Nov. 7, 2019

(30) Foreign Application Priority Data

May 1, 2018 (JP) ..... 2018-088039

(51) Int. Cl.
*G03G 15/08* (2006.01)

(52) U.S. Cl.
CPC ..... *G03G 15/0886* (2013.01); *G03G 15/0867* (2013.01); *G03G 2215/0678* (2013.01); *G03G 2215/0692* (2013.01)

(58) Field of Classification Search
USPC ..... 399/260
See application file for complete search history.

(56) References Cited

U.S. PATENT DOCUMENTS

2008/0101821 A1* 5/2008 Gayne ..... G03G 15/0875 399/258
2010/0247160 A1* 9/2010 Ohta ..... G03G 15/0875 399/262
2012/0114386 A1* 5/2012 Takashima ..... G03G 15/0879 399/258
2013/0243491 A1* 9/2013 Nodera ..... G03G 15/0886 399/260

FOREIGN PATENT DOCUMENTS

JP 2011034118 A 2/2011

* cited by examiner

*Primary Examiner* — Quana Grainger
(74) *Attorney, Agent, or Firm* — Holtz, Holtz & Volek PC

(57) ABSTRACT

A toner supply device includes: a device body; and a toner bottle, wherein a toner supply port is formed in each of the device body and the toner bottle, either one of the device body and the toner bottle includes: a shutter that can be selectively moved between a shielding position and an open position; and a first engagement part, the other one of the device body and the toner bottle includes a second engagement part, the shutter is moved from the shielding position to the open position and the shutter opens the toner supply port, and then the first engagement part is engaged with the second engagement part, and the shutter is moved from the open position to the shielding position and the shutter closes the toner supply port, and then engagement between the first engagement part and the second engagement part is disengaged.

9 Claims, 16 Drawing Sheets

TONER SUPPLY DEVICE WITH MOVABLE TONER BOTTLE

The entire disclosure of Japanese patent Application No. 2018-088039, filed on May 1, 2018, is incorporated herein by reference in its entirety.

BACKGROUND

Technological Field

The present disclosure relates to a toner supply device and an image forming apparatus.

Description of the Related Art

JP 2011-34118 A discloses a conventional toner storage container having a structure including: a flexible container body in which toner is stored; and a bottom plate member detachably supporting the container body, and further including a shutter that covers a toner discharge port formed in the container body.

In a toner supply device, it is required to attach a toner bottle at a correct position of a device body in order to appropriately supply toner.

SUMMARY

According to an embodiment of the present disclosure, an object is to provide a toner supply device in which a toner bottle can be attached at an appropriate position, and an image forming apparatus including the toner supply device.

To achieve the abovementioned object, according to an aspect of the present invention, a toner supply device reflecting one aspect of the present invention comprises: a device body; and a toner bottle that can be attached to or detached from the device body, wherein a toner supply port through which toner to be supplied to the device body from the toner bottle passes is formed in each of the device body and the toner bottle, either one of the device body and the toner bottle includes: a shutter that can be selectively moved between a shielding position to shield the toner supply port and an open position to open the toner supply port; and a first engagement part that is moved in conjunction with the shutter, the other one of the device body and the toner bottle includes a second engagement part that can be engaged with the first engagement part, the shutter is moved, during attachment operation to attach the toner bottle to the device body, from the shielding position to the open position and the shutter opens the toner supply port by moving the second engagement part while the second engagement part abuts on the first engagement part, and then the first engagement part is engaged with the second engagement part in a manner integrally movable, and the shutter is moved, during detachment operation to detach the toner bottle from the device body, from the open position to the shielding position and the shutter closes the toner supply port in the state in which the first engagement part and the second engagement part are engaged with each other, and then engagement between the first engagement part and the second engagement part is disengaged.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments. In the following description, identical components and identical constituent elements will be denoted by the same reference signs. Names and functions thereof are also the same. Therefore, detailed descriptions thereof will not be repeated.

<Image Forming Apparatus 100>

Figure 1:
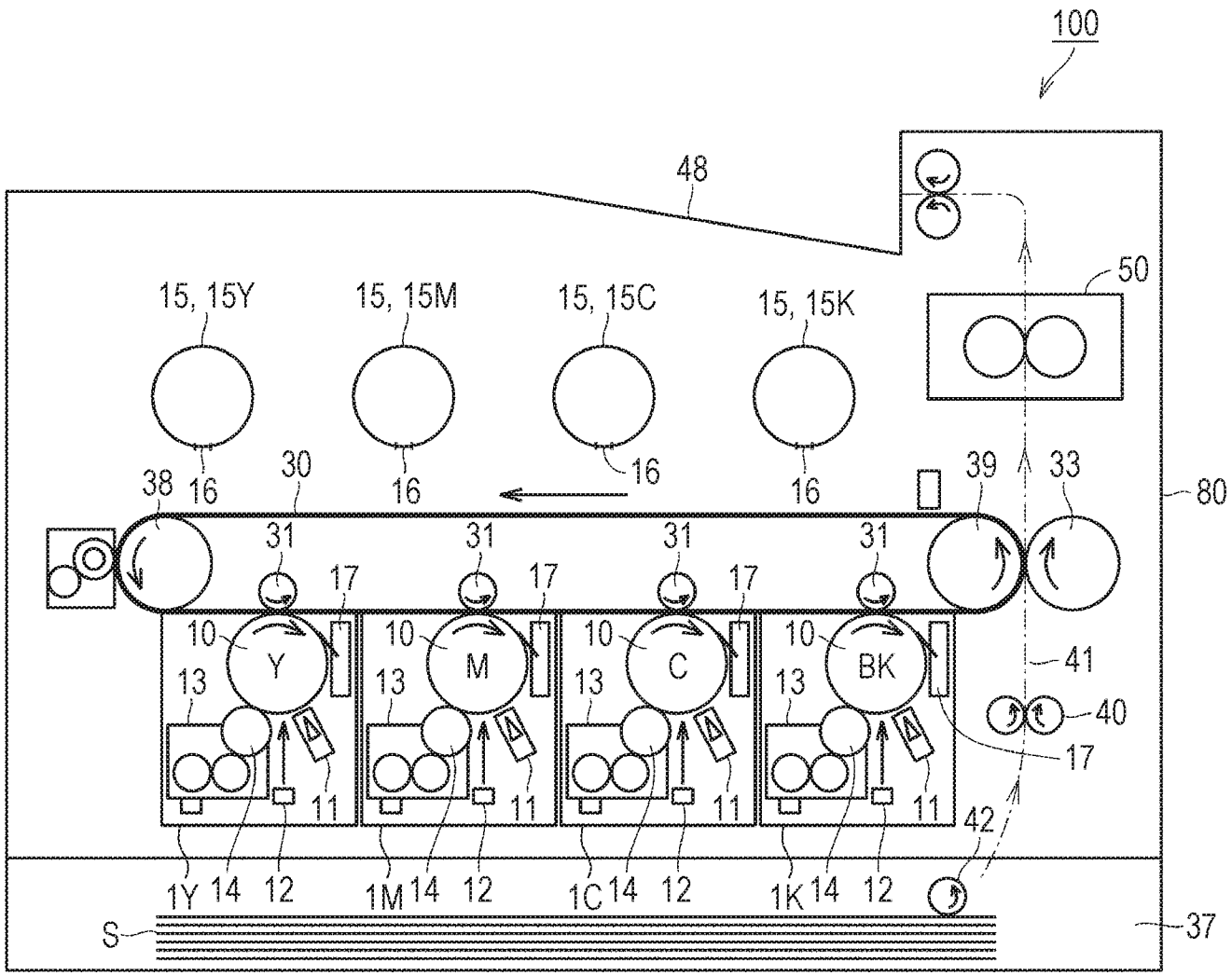
FIG. 1 is a schematic structural view illustrating an image forming apparatus according to an embodiment of the present invention.

FIG. 1 is a schematic view of an image forming apparatus 100 according to an embodiment. FIG. 1 illustrates the image forming apparatus 100 as a color printer. Hereinafter, the color printer will be described, but the image forming apparatus 100 is not limited to the color printer. For example, the image forming apparatus 100 may be a monochrome printer, may be a color printer, may be a facsimile machine, or may be a multi-functional peripheral (MFP) including a monochrome printer, a color printer, and a facsimile machine.

The image forming apparatus 100 includes image forming units 1Y, 1M, 1C, and 1K, an intermediate transfer belt 30, a primary transfer roller 31, a secondary transfer roller 33, a cassette 37, a driven roller 38, a drive roller 39, a timing roller 40, a fixing device 50, and a casing 80.

The casing 80 defines an outer shell of the image forming apparatus 100. The casing 80 houses, inside thereof the image forming units 1Y, 1M, 1C, and 1K, the intermediate transfer belt 30, the primary transfer roller 31, the secondary transfer roller 33, the cassette 37, the driven roller 38, the drive roller 39, the timing roller 40, and the fixing device 50.

The image forming units 1Y, 1M, 1C, and 1K, the intermediate transfer belt 30, the primary transfer roller 31, the secondary transfer roller 33, the cassette 37, the driven roller 38, the drive roller 39, and the timing roller 40 constitute an image former. The image former forms a toner image on a sheet S as a recording medium conveyed along a conveyance path 41 described later.

The image forming units 1Y, 1M, 1C, and 1K are sequentially arranged along the intermediate transfer belt 30. The image forming unit 1Y receives toner supply from a toner bottle 15Y to form a yellow (Y) toner image. The image forming unit 1M receives toner supply from a toner bottle 15M to form a magenta (M) toner image. The image forming unit 1C receives toner supply from a toner bottle 15C to form a cyan (C) toner image. The image forming unit 1K receives toner supply from a toner bottle 15K to form a black (BK) toner image.

The image forming units 1Y, 1M, 1C, and 1K are sequentially arranged along the intermediate transfer belt 30 in a rotation direction of the intermediate transfer belt 30. Each of the image forming units 1Y, 1M, 1C, and 1K includes a photoreceptor 10, a charging device 11, an exposure device 12, a developing device 13, and a cleaning device 17.

The charging device 11 uniformly charges a surface of the photoreceptor 10. The exposure device 12 irradiates the photoreceptor 10 with laser light and exposes the surface of the photoreceptor 10 in accordance with a received image pattern. Consequently, an electrostatic latent image corresponding to a received image is formed on the photoreceptor 10.

The developing device 13 applies developing bias to a developing roller 14 while rotating the developing roller 14, and makes toner adhere to the surface of the developing roller 14. Consequently, the toner is transferred from the developing roller 14 to the photoreceptor 10, and a toner image corresponding to the electrostatic latent image is developed on the surface of the photoreceptor 10. The photoreceptor 10 has a function as an image carrier that carries a toner image on the surface thereof.

The photoreceptor 10 and the intermediate transfer belt 30 contact each other at a part where the primary transfer roller 31 is provided. The primary transfer roller 31 has a roller shape and is rotatable. Transfer voltage having a polarity opposite to a polarity of the toner image is applied to the primary transfer roller 31, thereby transferring toner image from the photoreceptor 10 to the intermediate transfer belt 30. A yellow (Y) toner image, a magenta (M) toner image, a cyan (C) toner image, and a black (BK) toner image are sequentially superimposed and transferred from the photoreceptors 10 to the intermediate transfer belt 30. Consequently, a color toner image is formed on the intermediate transfer belt 30.

The intermediate transfer belt 30 is stretched around the driven roller 38 and the drive roller 39. The drive roller 39 is rotationally driven by a motor (not illustrated), for example. The intermediate transfer belt 30 and the driven roller 38 are rotated in conjunction with the drive roller 39. Consequently, the toner image on the intermediate transfer belt 30 is conveyed to the secondary transfer roller 33.

The cleaning device 17 contacts and is pressed against the photoreceptor 10. The cleaning device 17 collects the toner remaining on the surface of the photoreceptor 10 after transference of the toner image.

In the cassette 37, sheets S are set. The sheets S are fed one by one from the cassette 37 by a pickup roller 42 and conveyed to the secondary transfer roller 33 along the conveyance path 41 by the timing roller 40.

The secondary transfer roller 33 has a roller shape and is rotatable. The secondary transfer roller 33 applies, to a sheet S being conveyed, the transfer voltage having the polarity opposite to the polarity of the toner image. Consequently, the toner image is attracted from the intermediate transfer belt 30 to the secondary transfer roller 33, and the toner image on the intermediate transfer belt 30 is transferred. The conveyance timing of the sheet S to the secondary transfer roller 33 is adjusted by the timing roller 40 in accordance with a position of the toner image on the intermediate transfer belt 30. The toner image on the intermediate transfer belt 30 is transferred to an appropriate position on the sheet S by the timing roller 40.

The fixing device 50 pressurizes and heats the sheet S passing through the fixing device. Consequently, the toner image is fixed on the sheet S. The fixing device 50 fixes the toner image on the sheet S conveyed along the conveyance path 41. The sheet S on which the toner image has been fixed is ejected to a tray 48.

In the above description, the image forming apparatus 100 adopting a tandem system as a printing system has been described, but the printing system of the image forming apparatus 100 is not limited to the tandem system. Arrangement of the respective constituent elements in the image forming apparatus 100 can be changed as appropriate in accordance with the adopted printing system. As the printing system of the image forming apparatus 100, a rotary system or a direct transfer system may also be adopted. In the case of the rotary system, the image forming apparatus 100 includes one photoreceptor 10 and a plurality of developing devices 13 coaxially rotatable. At the time of printing, the image forming apparatus 100 sequentially guides each of the developing devices 13 to the photoreceptor 10 and develops a toner image of each color. In the case of the direct transfer system, the toner image formed on the photoreceptor 10 is directly transferred onto the sheet S in the image forming apparatus 100.

(Toner Bottle 15)

Figure 2:
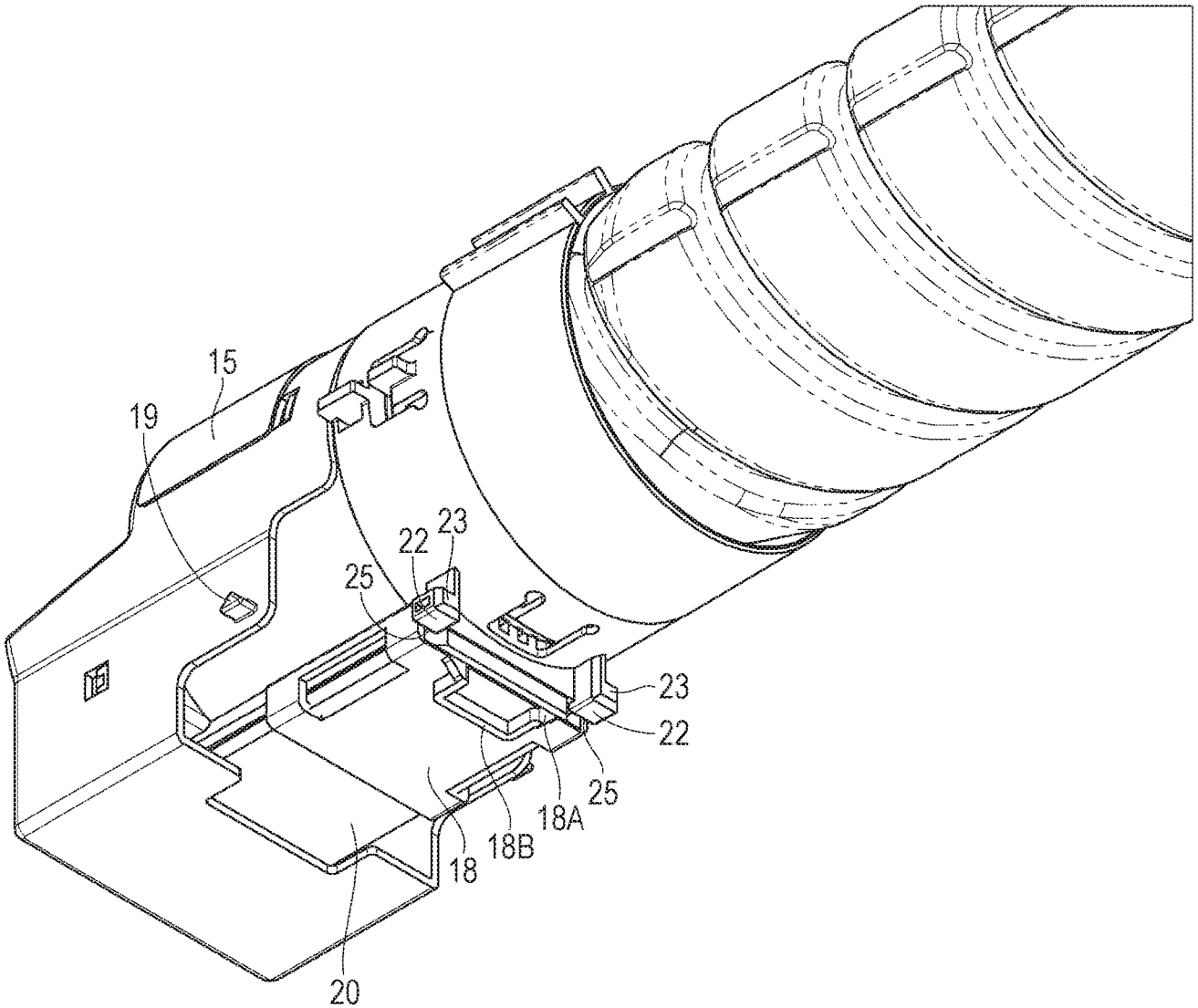
FIG. 2 is a perspective view illustrating a schematic structure of a toner bottle.

FIG. 2 is a perspective view illustrating a schematic structure of the toner bottle 15. Toner bottles 15Y, 15M, 15C, and 15K included in the image forming apparatus 100 are collectively referred to as toner bottles 15 in the following. Each toner bottle 15 contains toner of each color inside thereof. As illustrated in FIG. 1, the toner bottle 15 of each color has a toner supply port 16 formed therein. The toner supply port 16 is formed at a lower surface of the toner bottle 15.

The toner bottle 15 includes a shutter 18 that opens/closes the toner supply port 16. The shutter 18 is movable relative to a body of the toner bottle 15. The shutter 18 illustrated in FIG. 2 covers the toner supply port 16 from the lower side. The shutter 18 includes a projection projecting downward from a body part of the shutter 18, that is, projecting in a direction away from the body of the toner bottle 15, and abutment parts 18A and 18B are provided in this projection The abutment part 18A faces one side in a longitudinal direction of the toner bottle 15 and the abutment part 18B faces the other side in the longitudinal direction of the toner bottle 15.

The toner bottle 15 includes a seal member 20. The seal member 20 is arranged between the body of the toner bottle 15 and the shutter 18, and seals the toner supply port 16. The seal member 20 includes, at a position corresponding to the toner supply port 16, a through hole penetrating the seal member 20 in a thickness direction.

The toner bottle 15 includes a guide protrusion 19 protruding from a side surface of the toner bottle 15. A pair of guide protrusions 19 is provided on both side parts of the toner bottle 15. Each guide protrusion 19 has a triangle shape in a side view. Typically, the guide protrusion 19 in the side view has an isosceles triangle shape, and a base of the isosceles triangle extends in the longitudinal direction of the toner bottle 15.

The toner bottle 15 includes a pair of engagement parts 22 protruding downward from the body of the toner bottle 15. Each engagement part 22 is fixed to the body of the toner bottle 15. Each engagement part 22 includes an abutment surface 23 and an engagement surface 25. The abutment surface 23 faces one side in the longitudinal direction of the toner bottle 15, and the engagement surface 25 faces the other side in the longitudinal direction of the toner bottle 15.

The toner bottle 15 is detachable to the casing 80 of the image forming apparatus 100 (FIG. 1). While the toner bottle 15 is being detached from the casing 80, the shutter 18 is set at a position to close the toner supply port 16. The shutter 18 is moved to a position to open the toner supply port 16, thereby discharging the toner contained in the toner bottle 15 to the outside of the toner bottle 15 through the toner supply port 16 and the through hole formed in the seal member 20 The toner is supplied to the developing device 13 (FIG. 1) in each of the image forming units 1Y, 1M, 1C, and 1K through a toner supply path (not illustrated).

(Device Body 61)

Figure 3:
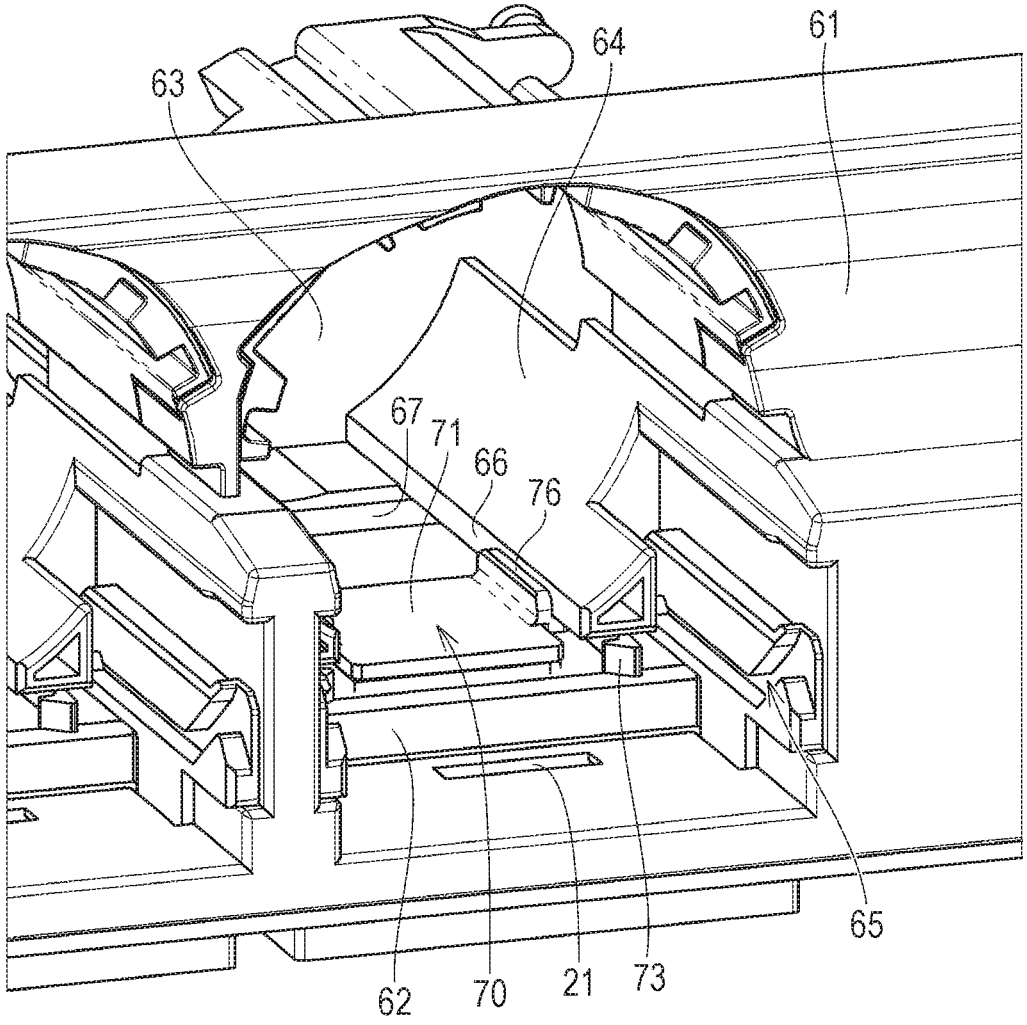
FIG. 3 is a perspective view illustrating a schematic structure of a device body.

FIG. 3 is a perspective view illustrating a schematic structure of a device body 61. The toner bottle 15 illustrated in FIG. 2 is detachable from the device body 61. As illustrated in FIG. 3, in the device body 61, a plurality (four in the embodiment) of hollow housing spaces 63 is formed to house the toner bottles 15. When each toner bottle 15 is attached to the device body 61 or each toner bottle 15 is detached from the device body 61, the toner bottle 15 is relatively moved in the longitudinal direction of the toner bottle 15 with respect to the device body 61. In a case where a floor surface or a desk on which the image forming apparatus 100 is placed is horizontal, the relative movement direction of the toner bottle 15 extends in the horizontal direction.

The relative movement direction of the toner bottle 15 with respect to the device body 61 will be also referred to as a front-rear direction in the present specification. The movement direction of the toner bottle 15 at the time of attaching the toner bottle 15 to the device body 61 is defined as a rear direction, and the movement direction of the toner bottle 15 at the time of detaching the toner bottle 15 from the device body 61 is defined as a front direction. Note that the front side will be also referred to as a near side, and the rear side will be also referred to as a deep side.

Figure 4:
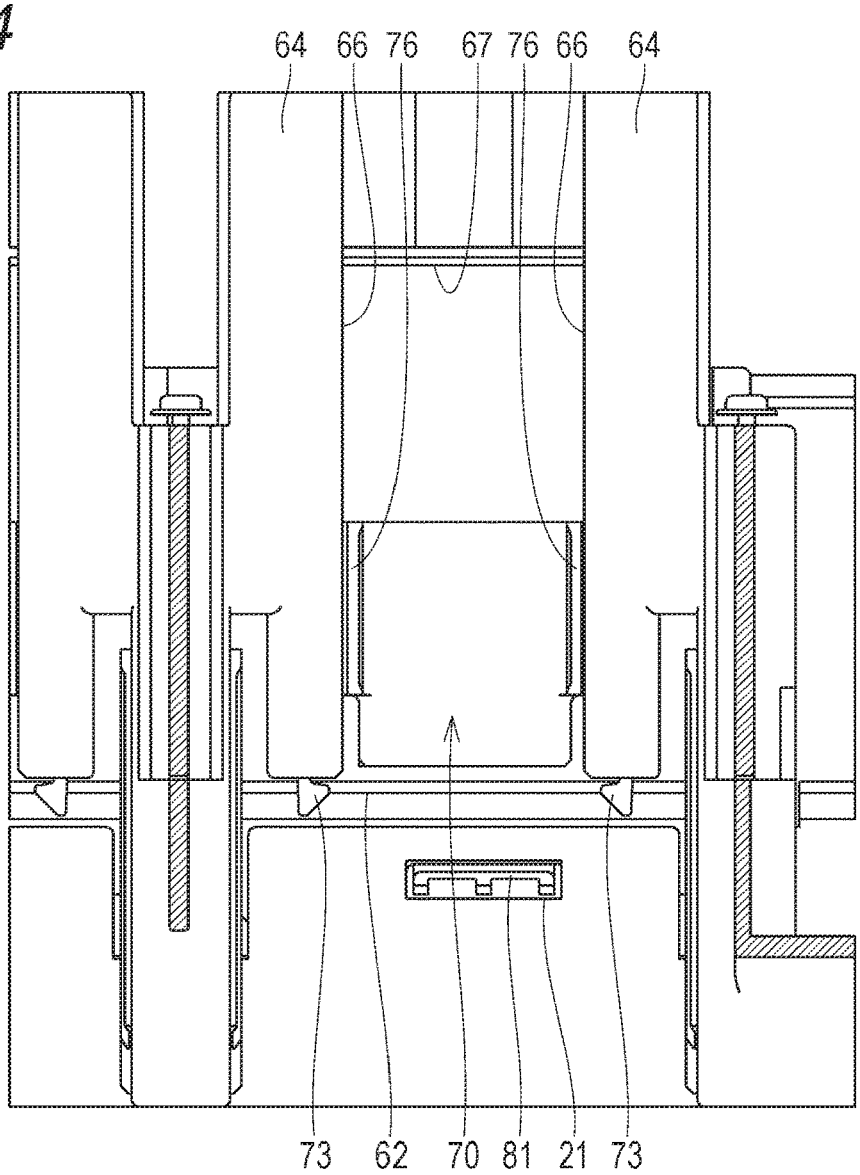
FIG. 4 is a plan view of the device body illustrating a structure inside a housing space.

FIG. 4 is a plan view of the device body 61, illustrating a structure inside each housing space 63. The relative movement direction of the toner bottle 15 with respect to the device body 61 is a vertical direction in FIG. 4. As illustrated in FIGS. 3 and 4, the device body 61 includes an abutment wall 62. The abutment wall 62 has a wall shape which is orthogonal to the front-rear direction and extends in the vertical direction. The abutment wall 62 forms a level difference on a floor surface of the housing space 63. The floor surface of the device body 61 located on the nearer side than the abutment wall 62 is formed lower by one level compared with the floor surface of the device body 61 located on the deeper side than the abutment wall 62.

An opening 21 at which the floor surface of the housing space 63 is opened is formed on the nearer side than the abutment wall 62. As illustrated in FIG. 4, a regulating part 81 is arranged inside the opening 21. The regulating part 81 is movable in the vertical direction. The regulating part 81 can protrude upward from the opening 21, or can be set below the opening 21.

The device body 61 includes a pair of insertion guides 64. The insertion guides 64 are arranged on the deeper side than the abutment wall 62. Each insertion guide 64 has a shape of a part of a cylindrical surface. The toner bottle 15 housed in the housing space 63 is received by the insertion guides 64 and supported by the insertion guides 64. The toner bottle 15 that is moved inside the housing space 63 slides with respect to the insertion guides 64.

The device body 61 includes a pair of guide parts 65. The guide parts 65 are provided on both side surfaces of the housing space 63. In each guide part 65, a guide groove is formed. When the toner bottle 15 is attached to or detached from the device body 61, the guide protrusions 19 of the toner bottle 15 are engaged with the guide parts 65 and relatively moved with respect to the guide parts 65 along the guide grooves. The guide parts 65 guide the guide protrusions 19 during attachment/detachment operation of the toner bottle 15 with respect to the device body 61.

The device body 61 includes a shutter 70. The shutter 70 is movable with respect to the device body 61. A toner supply port 26 (not illustrated in FIGS. 3 and 4) is formed in the device body 61. The toner supply port 26 is formed on the deeper side than the abutment wall 62. The toner supply port 26 is an opening to receive the toner discharged from the toner supply port 16 of the toner bottle 15, and forms an entrance of the toner supply path that guides the toner to the developing device 13. The shutter 70 illustrated in FIGS. 3 and 4 covers the toner supply port 26 from above. The shutter 70 is set at a shielding position to shield the toner supply port 26. The shutter 70 opens and closes the toner supply port 26 by relatively moving itself with respect to the device body 61.

Figure 5:
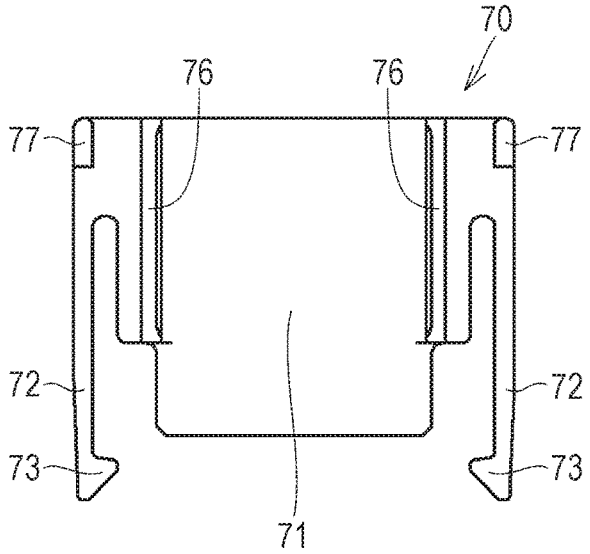
FIG. 5 is a plan view of a shutter provided in the device body.

FIG. 5 is a plan view of the shutter 70 provided in the device body 61. As illustrated in FIG. 5, the shutter 70 includes a shutter body 71, ribs 76, and protrusions 77.

The shutter body 71 has a flat plate shape and is a part to open and close the toner supply port 26. The ribs 76 and the protrusions 77 protrude upward from the shutter body 71. Referring to FIGS. 3 and 4 together, the insertion guides 64 are not provided on the floor surface of the housing space 63, and a pair of guide walls 66 extending in the front-rear direction is formed. Each rib 76 faces each guide wall 66. Since the rib 76 is guided by the guide wall 66, the rib 76 extends in the front-rear direction, and the shutter 70 is defined so as to be relatively moved in the front-rear direction without being tilted with respect to the device body 61.

An abutment wall 67 is provided between the pair of guide walls 66. The abutment wall 67 has a wall shape which is orthogonal to the front-rear direction and extends in the vertical direction. The abutment wall 67 forms a level difference on the floor surface of the housing space 63. The floor surface of the device body 61 located on the nearer side than the abutment wall 67 is formed lower by one level compared with the floor surface of the device body 61 located on the deeper side than the abutment wall 67. The abutment wall 67 faces the shutter 70, more specifically, the shutter body 71. The abutment wall 67 is arranged at the deepest part in a movement path of the shutter 70.

The shutter 70 further includes an arm 72 and an engagement part 73. The engagement part 73 is provided at a tip of the arm 72. The shutter 70 includes a pair of the arms 72, and therefore, a plurality (two) of the engagement parts 73 is provided as well. When the shutter 70 (shutter body 71) is set at the position to close the toner supply port 26 as illustrated in FIGS. 3 and 4, each arm 72 extends in the front-rear direction, and each engagement part 73 is provided at a front end of each arm 72. Each engagement part 73 is set at a position overlapping with the abutment wall 62 in the front-rear direction.

Figure 6:
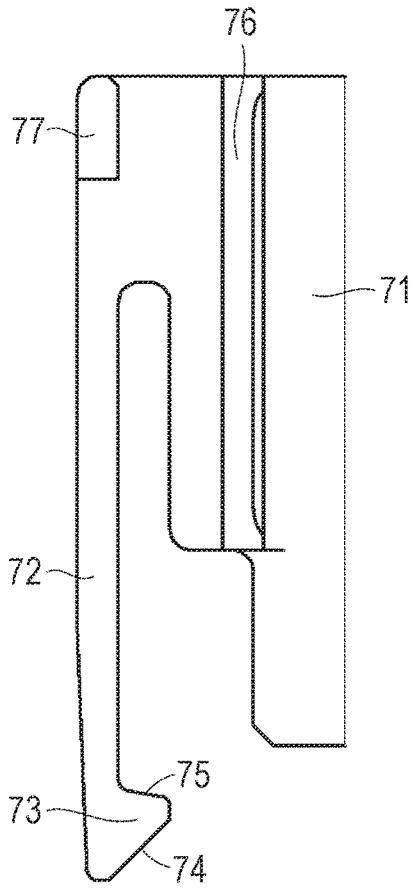
FIG. 6 is a partial plan view of the shutter, illustrating an engagement part in an enlarged manner.

FIG. 6 is a partial plan view of the shutter 70, illustrating each engagement part 73 in an enlarged manner. As illustrated in FIG. 6, the engagement part 73 includes an inclined surface 74 and an engagement surface 75. The inclined surface 74 faces the front side and the engagement surface 75 faces the rear side. Both the inclined surface 74 and the engagement surface 75 extend in a manner inclined from the front-rear direction. An angle at which the inclined surface 74 is inclined from the front-rear direction is larger than an angle at which the engagement surface 75 is inclined.

Figure 7:
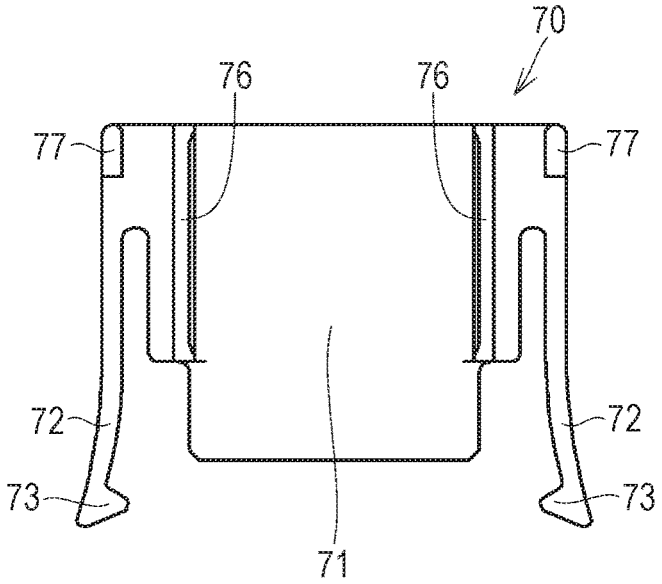
FIG. 7 is a plan view of the shutter in a state in which arms are elastically deformed.

FIG. 7 is a plan view of the shutter 70 in a state in which the arms 72 are elastically deformed. Compared with FIG. 5, the arms 72 illustrated in FIG. 7 are elastically deformed in directions away from the shutter body 71. The engagement parts 73 at the tip of the arms 72 are moved in directions each intersecting with the front-rear direction. A distance between the two engagement parts 73 illustrated in FIG. 7 is larger than that in FIG. 5. The two engagement parts 73 are moved in directions away from each other.

Figure 8:
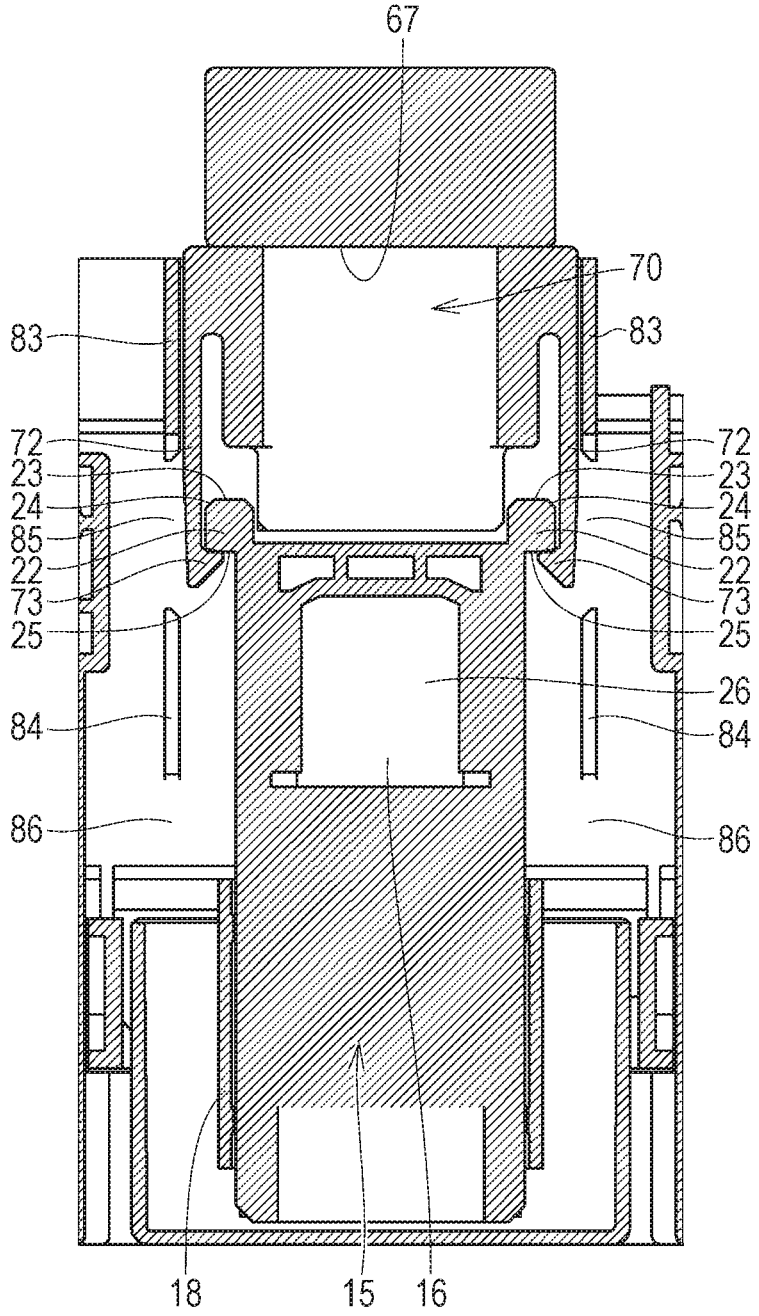
FIG. 8 is a plan view of a toner supply device illustrating a state in which a toner supply port is opened.

FIG. 8 is a plan view of the toner supply device illustrating a state in which the toner supply ports 16 and 26 are opened. As illustrated in FIG. 8, the toner bottle 15 is attached to the device body 61. The engagement surfaces 25 of the engagement parts 22 of the toner bottle 15 and the engagement surfaces 75 of the engagement parts 73 of the shutter 70 are engaged with each other.

The shutter 18 of the toner bottle 15 is set on the nearer side than the toner supply port 16, and the toner supply port 16 is not covered with the shutter 18 and opened. The shutter 70 of the device body 61 is set on the deeper side than the toner supply port 26, and the toner supply port 26 is not covered with the shutter 70 and opened. As illustrated in FIG. 8, in the plan view, the toner supply port 16 and the toner supply port 26 overlap with each other. Consequently, a passage of the toner supplied from the toner bottle 15 to the device body 61 is formed as a path sequentially passing through the toner supply port 16 and the toner supply port 26.

The device body 61 includes guide rails 83 and 84. The guide rails 83 and 84 each have a rib-like shape protruding upward from the floor surface of the device body 61 and extending in the front-rear direction. Each arm 72 of the shutter 70 is movable along the guide rails 83 and 84. One pair of guide rails 83 and one pair of guide rails 84 are provided for each of the pair of arms 72.

The guide rail 83 and the guide rail 84 are arranged apart from each other in the front-rear direction. A relief part 85 not provided with any guide rail is formed between the guide rail 83 and the guide rail 84. A relief part 86 not provided with any guide rail is formed on the more front side than each guide rail 84.

(Attachment Operation of Toner Bottle 15)

Figure 9:
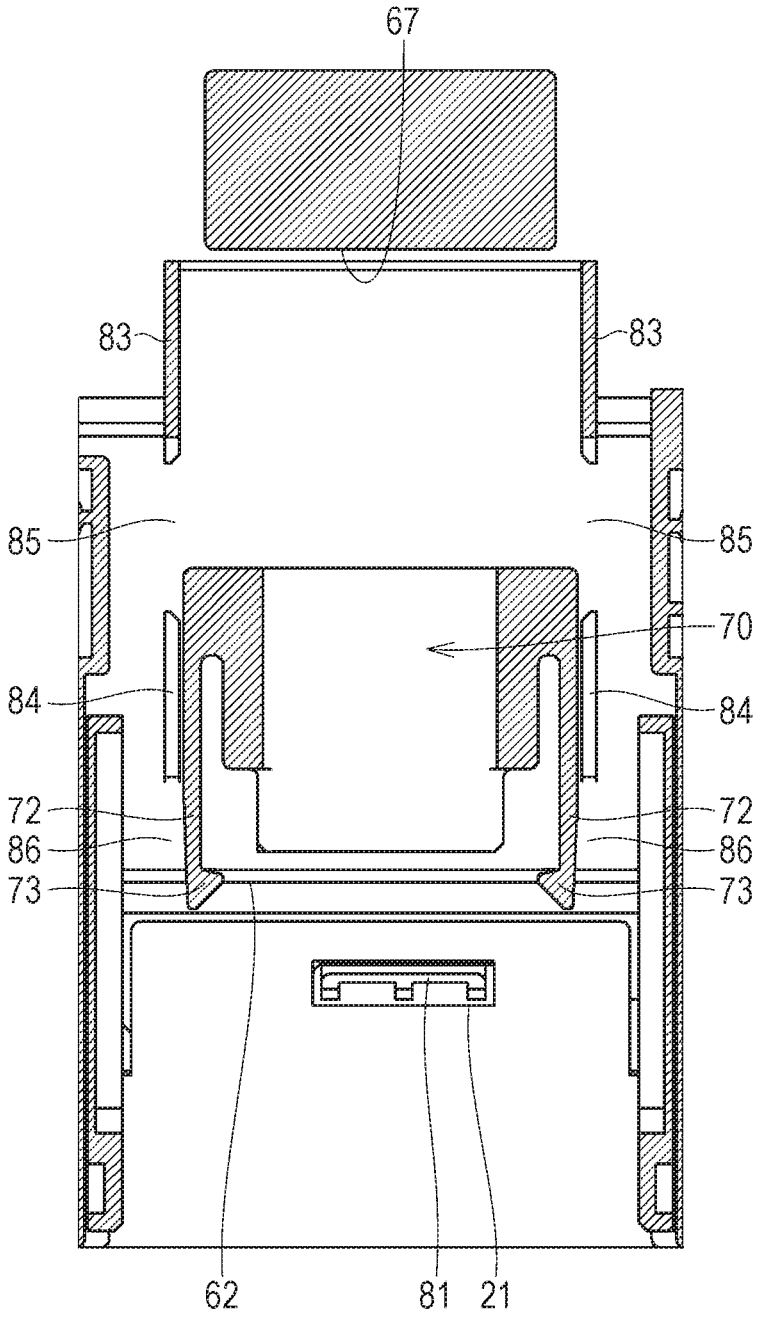
FIG. 9 is a cross-sectional view of the device body before attaching the toner bottle.

In the toner supply device having the above-described structure, attachment operation to attach the toner bottle 15 to the device body 61 will be described below. FIG. 9 is a cross-sectional view of the device body 61 before attaching the toner bottle 15. Similar to FIGS. 4 and 5, the shutter 70 illustrated in FIG. 9 is set at the shielding position to shield the toner supply port 26. The toner supply port 26 is covered with the shutter 70, and the toner supply port 26 cannot be visually recognized in FIG. 9.

Each arm 72 is set along the guide rail 84. Each engagement part 73 of the shutter 70 faces each relief part 86.

Figure 10:
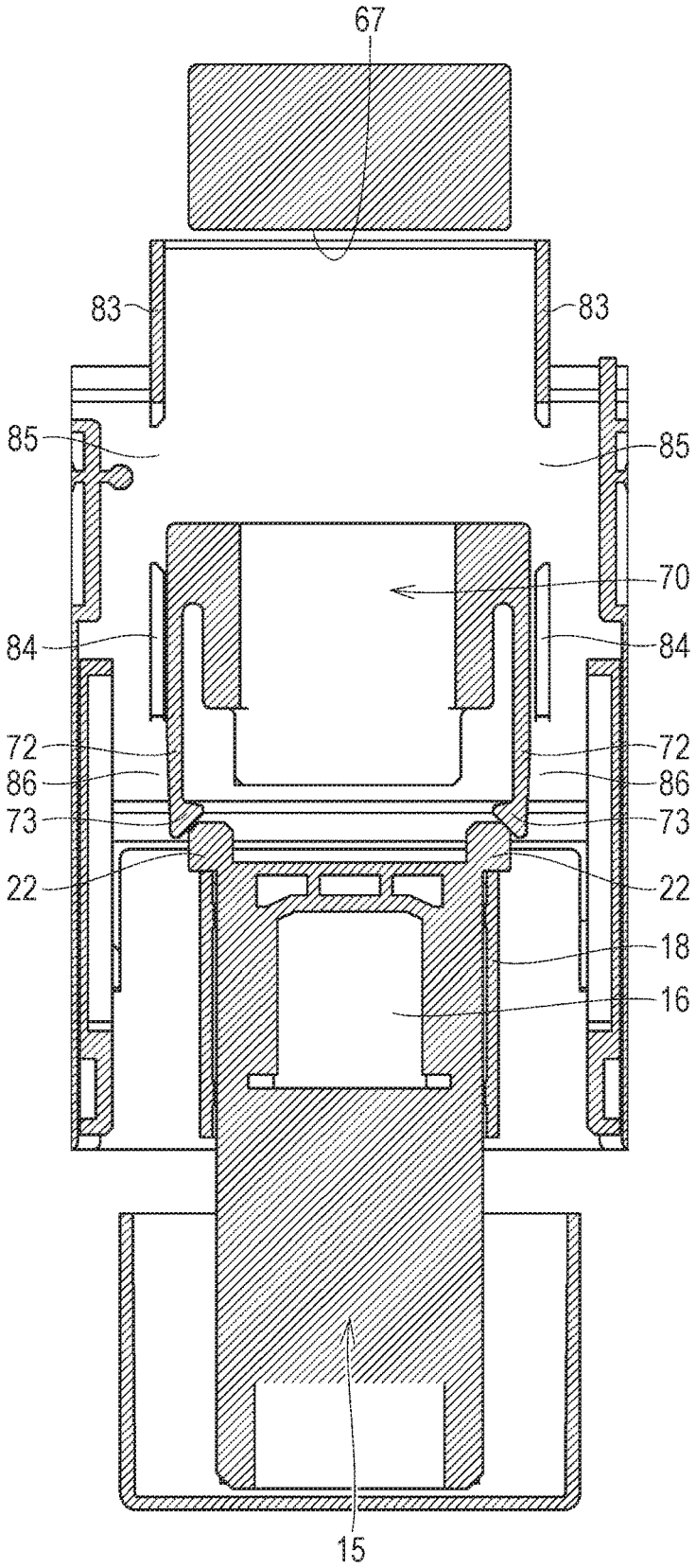
FIG. 10 is a cross-sectional view of the toner supply device, illustrating a first step of attachment operation.

FIG. 10 is a cross-sectional view of the toner supply device, illustrating a first step of attachment operation. As illustrated in FIG. 10, each engagement part 22 of the toner bottle 15 abuts on each engagement part 73 of the shutter 70 by pushing the toner bottle 15 into the housing space 63 of the device body 61. More specifically, a chamfered surface 24 (FIG. 8) formed on a peripheral edge of the abutment surface 23 of each engagement part 22 abuts on the inclined surface 74 of each engagement part 73.

Figure 11:
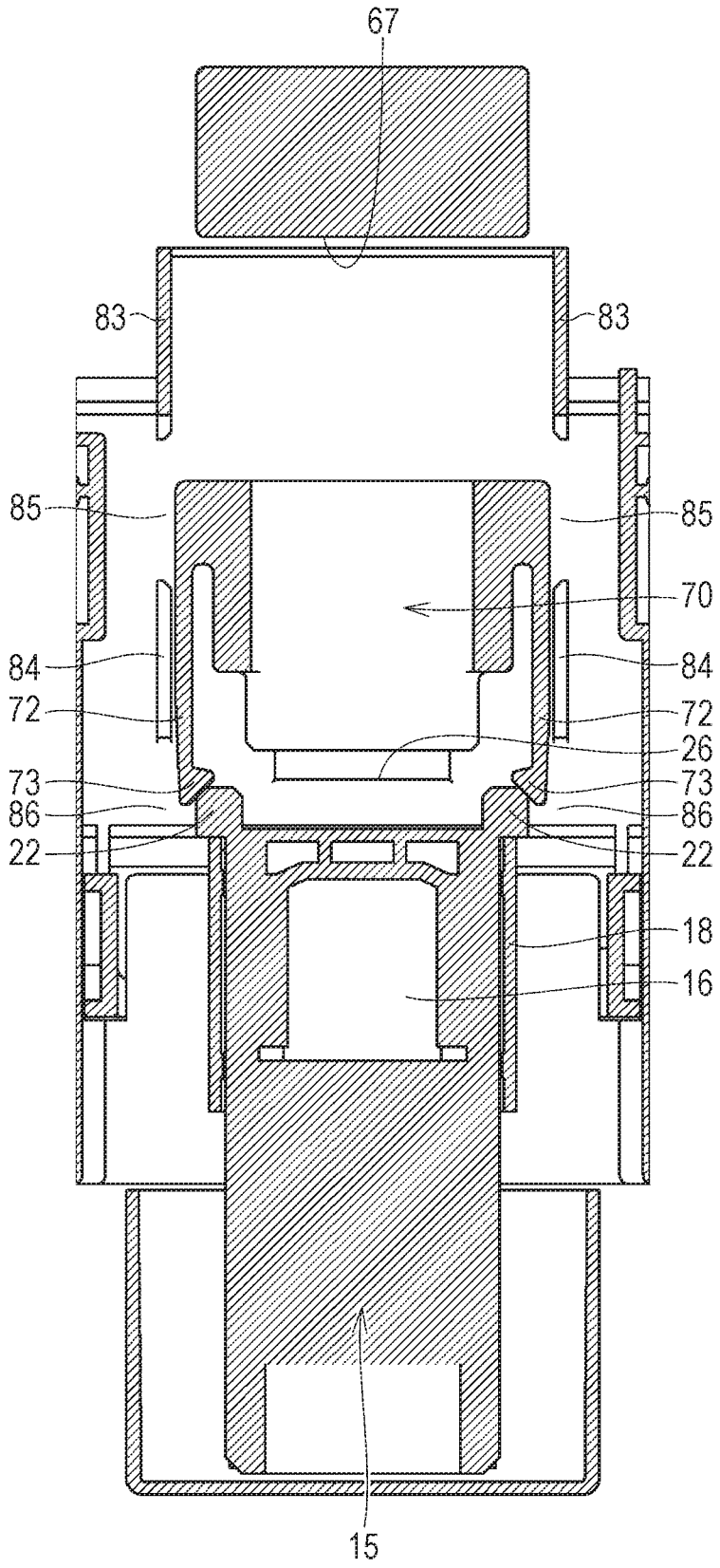
FIG. 11 is a cross-sectional view of the toner supply device, illustrating a second step of the attachment operation.

FIG. 11 is a cross-sectional view of the toner supply device, illustrating a second step of attachment operation. The toner bottle 15 is moved to the deeper side of the housing space 63 in a state in which each engagement part 22 of the toner bottle 15 abuts on each engagement part 73 of the shutter 70, thereby causing rearward stress to act on the shutter 70. Consequently, the shutter 70 is moved in the rear direction, and the toner supply port 26 is started to be opened.

The shutter 18 of the toner bottle 15 is integrally moved with the body of the toner bottle 15 toward the deep side of the housing space 63 until the shutter 18 (specifically, the abutment part 18A illustrated in FIG. 2) abuts on the abutment wall 62.

Figure 12:
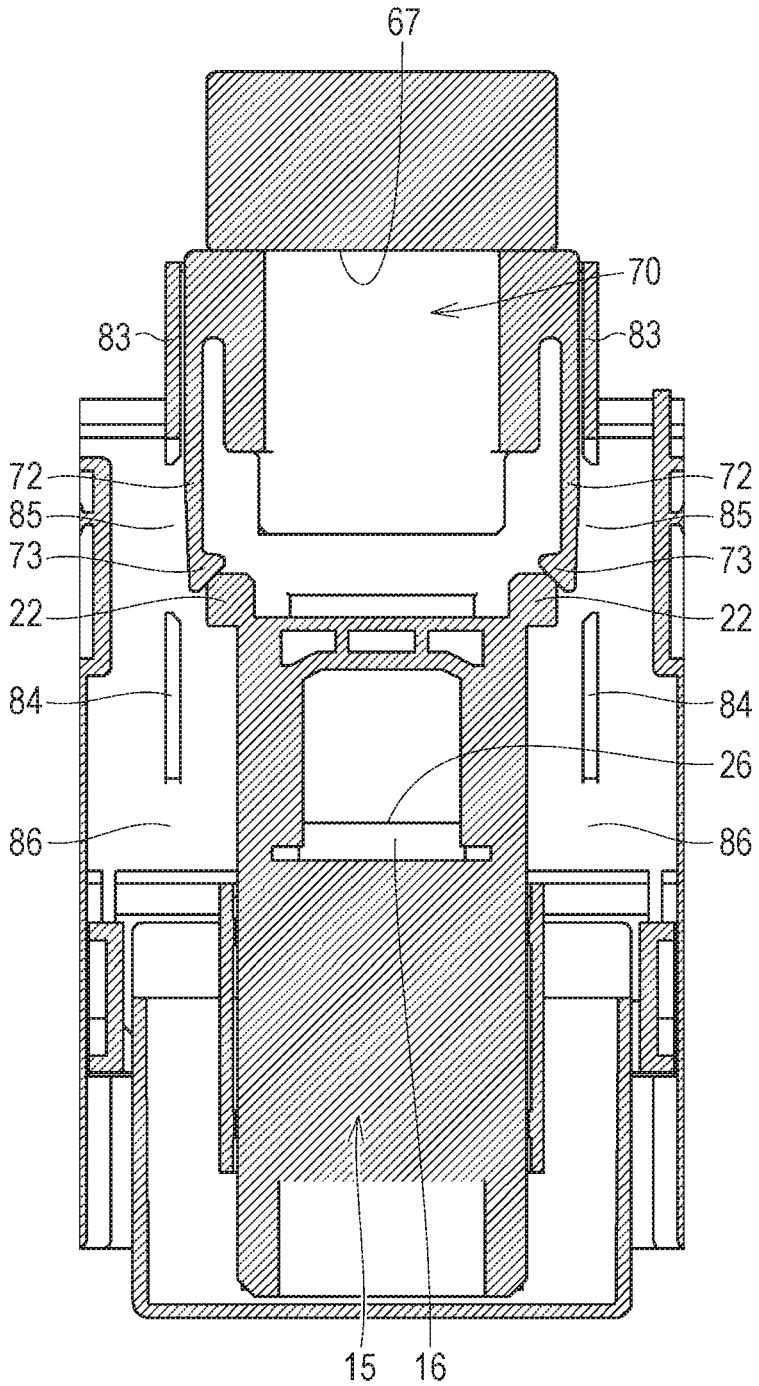
FIG. 12 is a cross-sectional view of the toner supply device, illustrating a third step of the attachment operation.

FIG. 12 is a cross-sectional view of the toner supply device, illustrating a third step of attachment operation. The shutter 18 of the toner bottle 15 abuts on the abutment wall 62, thereby the abutment wall 62 hindering movement of the shutter 18. Consequently, the shutter 18 is prevented from being moved together with the toner bottle 15, and the shutter 18 is relatively moved with respect to the toner supply port 16 formed in the toner bottle 15. As a result, the toner supply port 16 is opened, and the shutter 18 ceases to cover the toner supply port 16.

The shutter 70 of the device body 61 receives stress from the toner bottle 15 that is being moved in the rear direction until the shutter body 71 abuts on the abutment wall 67, and is moved to the deep side of the housing space 63 integrally with the toner bottle 15. The shutter 70 illustrated in FIG. 12 is set at an open position to open the toner supply port 26.

Figure 13:
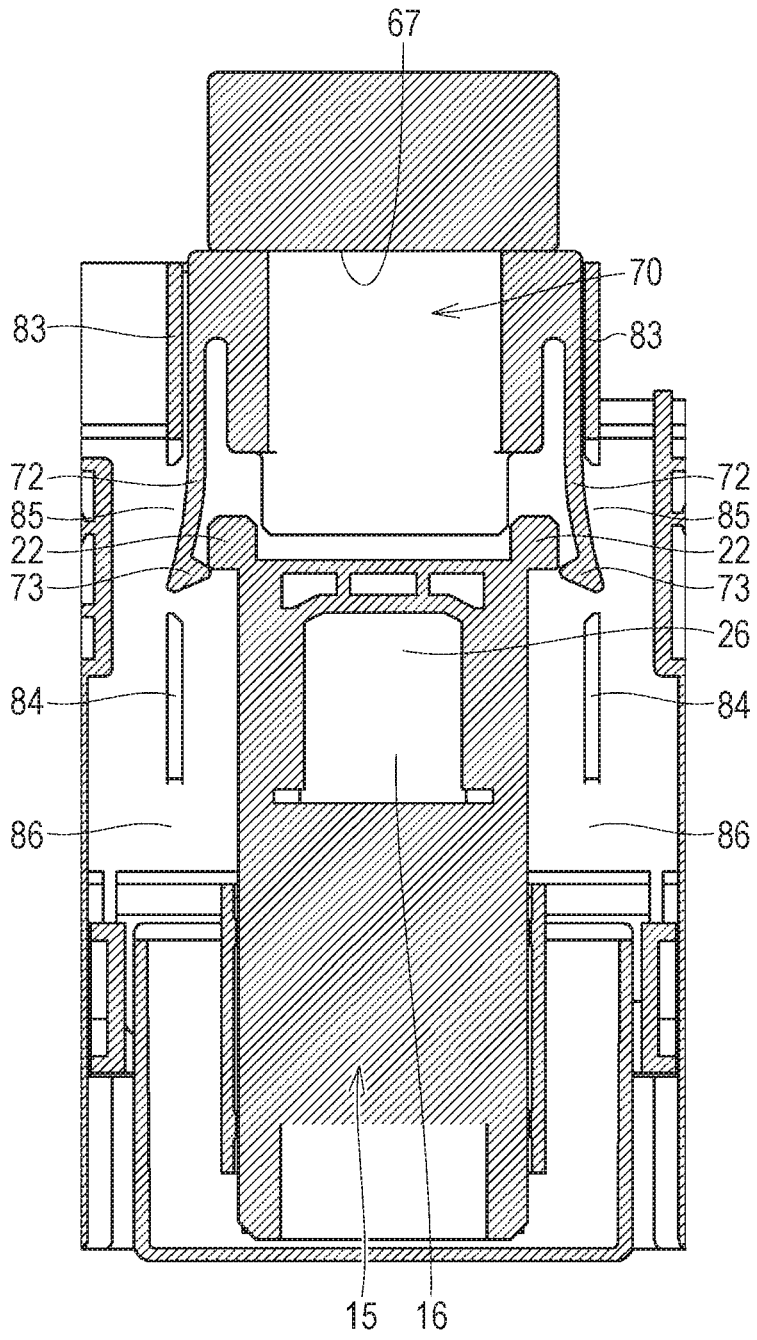
FIG. 13 is a cross-sectional view of the toner supply device, illustrating a fourth step of the attachment operation.

FIG. 13 is a cross-sectional view of the toner supply device, illustrating a fourth step of attachment operation. The shutter 70 abuts on the abutment wall 67 thereby the abutment wall 67 hindering movement of the shutter 70. Consequently, the shutter 70 is prevented from being moved in the rear direction.

The abutment wall 67 is arranged in a middle of the movement path of the toner bottle 15 when the toner bottle is attached to the device body 61. While the shutter 70 is stopped, movement of the toner bottle 15 in the rear direction is continued. Each engagement part 22 of the toner bottle 15 and each engagement part 73 of the shutter 70 are moved relative to each other, and the engagement part 22 slides on the inclined surface 74 of each engagement part 73. At this time, the distance between the pair of arms 72 is widened, and the arms 72 are elastically deformed such that the pair of engagement parts 73 is moved in directions away from the shutter body 71.

When the shutter 70 is set at the position abutting on the abutment wall 67, each engagement part 73 is located at the same position as each relief part 85 in the front-rear direction. Each engagement part 73 is set between the guide rail 83 and the guide rail 84 in the front-rear direction and is set at a position not overlapping with the guide rails 83 and 84 in the front-rear direction. Movement of each engagement part 73 in the direction away from the shutter body 71 is not hindered by the guide rails 83 and 84, and movement of each engagement part 73 in the direction away from the shutter body 71 is allowed.

Rigidity of each arm 72 is adjusted such that force necessary to elastically deform the arm 72 is larger than force necessary to move the shutter 70 in the rear direction. When the toner bottle 15 is attached, the arms 72 are not elastically deformed until the shutter 70 abuts on the abutment wall 67, and each of the arms 72 is moved in the rear direction while keeping the original shape. The shutter 70 stops movement by abutting on the abutment wall 67. The force necessary to move, in the rear direction, the shutter 70 that currently abuts on the abutment wall 67 is larger than the force necessary to elastically deform the arms 72. In the state in which the movement of the shutter 70 in the front-rear direction is regulated and the force necessary to move the shutter 70 in the front-rear direction is larger than the force necessary to elastically deform the arms 72, the arms 72 are elastically deformed, and a state between each engagement part 22 and each engagement part 73 is switched between engagement and disengagement.

Figure 14:
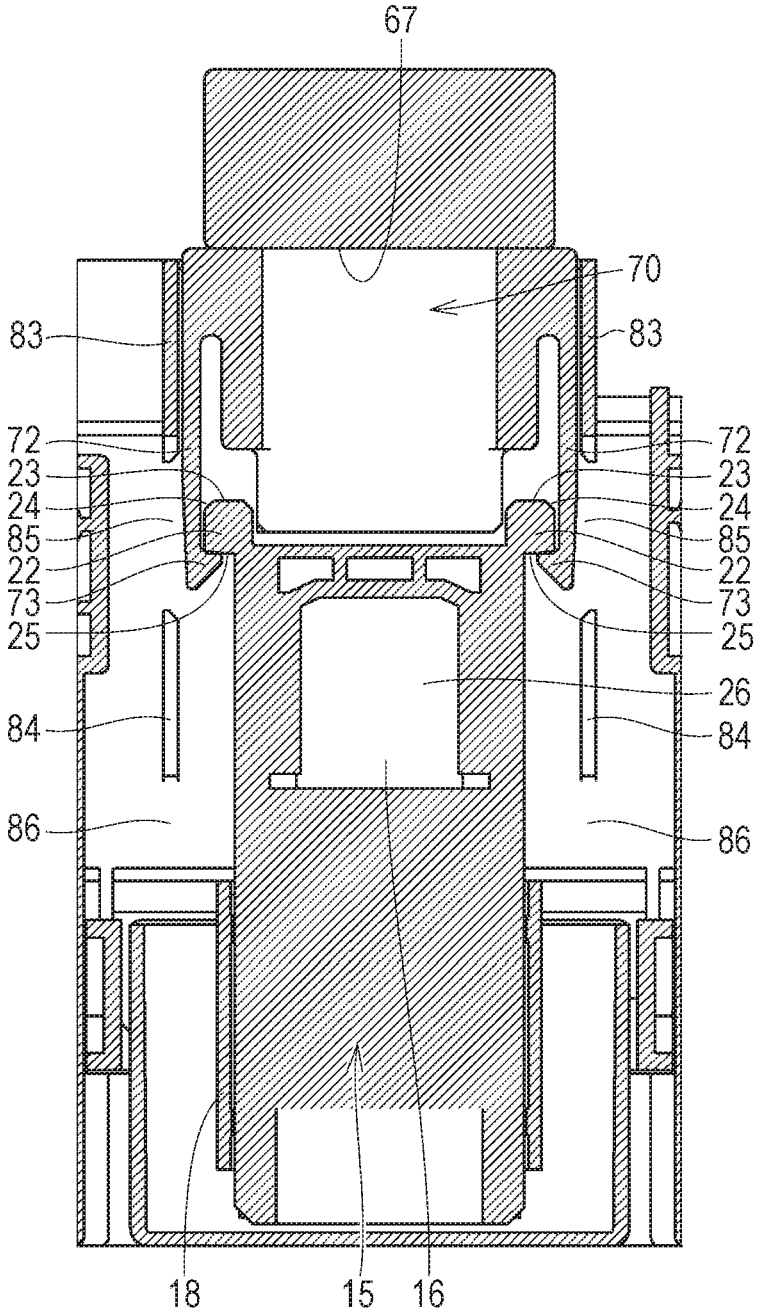
FIG. 14 is a cross-sectional view of the toner supply device, illustrating a fifth step of the attachment operation.

FIG. 14 is a cross-sectional view of the toner supply device, illustrating a fifth step of attachment operation. The toner bottle 15 is continuously moved with respect to the shutter 70 that is currently abuts on the abutment wall 67 and stops movement in the rear direction, and each engagement part 22 of the toner bottle 15 is moved more rearward than each engagement part 73 of the shutter 70. Since the stress which the engagement part 22 acts on the engagement part 73 is released, elastic deformation of each arm 72 is released and the shape of each arm 72 returns to the original shape. Each arm 72 returns to the shape extending in the front-rear direction.

In this state, the engagement surface 25 of each engagement part 22 of the toner bottle 15 is engaged with the engagement surface 75 of each engagement part 73 of the shutter 70.

Thus, as illustrated in FIGS. 10 to 12, the shutter 70 is moved from the shielding position to the open position to open the toner supply port 26 by each engagement part 22 of the toner bottle 15 abutting on each engagement part 73 of the shutter 70 and being moved in the rear direction. As illustrated in FIGS. 13 and 14, after insertion of the toner bottle 15 into the housing space 63 is completed and the shutter 70 is moved to the open position, each engagement part 22 is engaged with each engagement part 73 and locked-like state is obtained. Therefore, attachment of the toner bottle 15 at the appropriate position of the device body 61 can be facilitated.

Additionally, as illustrated in FIG. 6, each engagement part 73 of the shutter 70 includes the inclined surface 74. The inclined surface 74 extends in a manner inclined with respect to the front-rear direction that is the movement direction of the toner bottle 15. As illustrated in FIGS. 10 to 12, each engagement part 22 of the toner bottle 15 abuts on each inclined surface 74. As illustrated in FIG. 13, when the shutter 70 abuts on the abutment wall 67 and movement in the rear direction is regulated, the stress acting on each engagement part 73 from each engagement part 22 includes a component in the direction orthogonal to the front-rear direction (lateral direction in FIG. 13). Such stress urges the relative movement of the engagement part 73 with respect to the engagement part 22, and therefore, the engagement part 22 and the engagement part 73 can be easily engaged.

Additionally, as illustrated in FIGS. 5 and 7, the shutter 70 includes the plurality of engagement parts 73. Since the plurality of engagement parts 73 of the shutter 70 are engaged with the respective engagement parts 22 of the toner bottle 15, the locked-like state can be more ensured.

Additionally, as illustrated in FIGS. 12 and 13, the device body 61 includes the abutment wall 67 on which the shutter 70 having been moved to the open position abuts. The locked-like state can also be obtained by the shutter 70 abutting on the abutment wall 67 and being stopped. Furthermore, a position of the shutter 70 can be adjusted to the open position.

Additionally, as illustrated in FIG. 13, each engagement part 22 of the toner bottle 15 is engaged with each engagement part 73 of the shutter 70 by moving each engagement part 73 of the shutter 70 in the direction intersecting with the front-rear direction. As illustrated in FIGS. 10 to 12, while the shutter 70 is being moved from the shielding position to the open position, the engagement part 73 is not moved in a direction other than the front-rear direction. This prevents the engagement part 22 from being engaged with the engagement part 73 before the shutter 70 reaches the open position and avoids obtaining the locked-like state while the shutter 70 is being moved. Therefore, attachment of the toner bottle 15 at the appropriate position of the device body 61 can be surely facilitated.

Furthermore, as illustrated in FIG. 13, engagement between engagement between each engagement part 22 and each engagement part 73 is achieved when each engagement part 73 is moved in the intersecting direction after the shutter 70 reaches the open position and is stopped. Consequently, the locked-like state can be surely obtained after moving the shutter 70 to the open position.

Additionally, as illustrated in FIGS. 10 and 11, the device body 61 includes the guide rails 84. Each guide rail 84 has a function as a regulating member that hinders movement of each engagement part 73 in the intersecting direction while the shutter 70 is being moved from the shielding position to the open position. Each guide rail 84 regulates movement of each engagement part 73 in the intersecting direction in the middle of the movement path of the engagement part 73 being moved in the front-rear direction in conjunction with the shutter 70. Consequently, it is possible to surely prevent the locked-like state from being obtained by engagement between each engagement part 22 and each engagement part 73 while the shutter 70 is being moved.

Furthermore, as illustrated in FIG. 13, each guide rail 84 allows each engagement part 73 to be moved in the intersecting direction when the shutter 70 is located at the open position. Consequently, since the engagement part 73 is moved in the intersecting direction after moving the shutter 70 to the open position, the locked-state can be obtained by engaging each engagement part 73 with each engagement parts 22.

(Detachment Operation of Toner Bottle 15)

Figure 15:
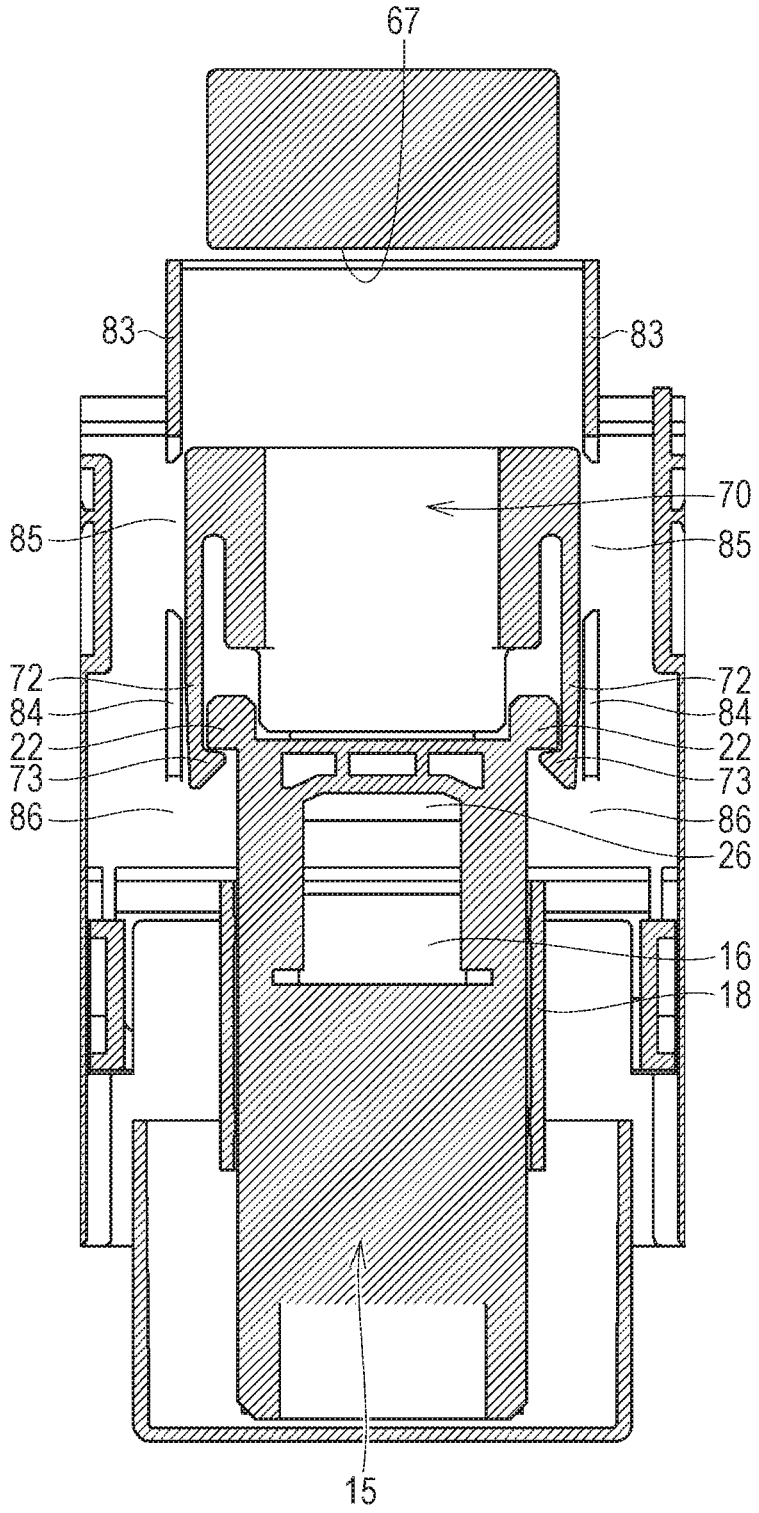
FIG. 15 is a cross-sectional view of the toner supply device, illustrating a first step of detachment operation.

Next, detachment operation to detach the toner bottle 15 from the device body 61 will be described. FIG. 15 is a cross-sectional view of the toner supply device, illustrating a first step of the detachment operation.

Each engagement part 22 of the toner bottle 15 is engaged with each engagement part 73 of the shutter 70, thereby integrally coupling the shutter 70 to the toner bottle 15 in a movable manner. When the toner bottle 15 is moved to the near side, the shutter 70 is moved together with the toner bottle 15, and the shutter 70 is separated from the abutment wall 67, and then moved to the near side.

The regulating part 81 (FIG. 4) protrudes upward from the opening 21 after the shutter 18 (abutment part 18A) abuts on the abutment wall 62 at the time of attaching the toner bottle 15 to the device body 61. In this state, the regulating part 81 is set above a lower end of the shutter 18 (more specifically, the abutment part 18B illustrated in FIG. 2). While the toner bottle 15 is being moved to the near side, the shutter 18 abuts on the regulating part 81 protruding from the opening 21 to regulate movement of the shutter 18. Consequently, the shutter 18 is relatively moved with respect to the toner supply port 16 formed in the toner bottle 15. As a result, the shutter 18 covers the toner supply port 16 to close the toner supply port 16.

Figure 16:
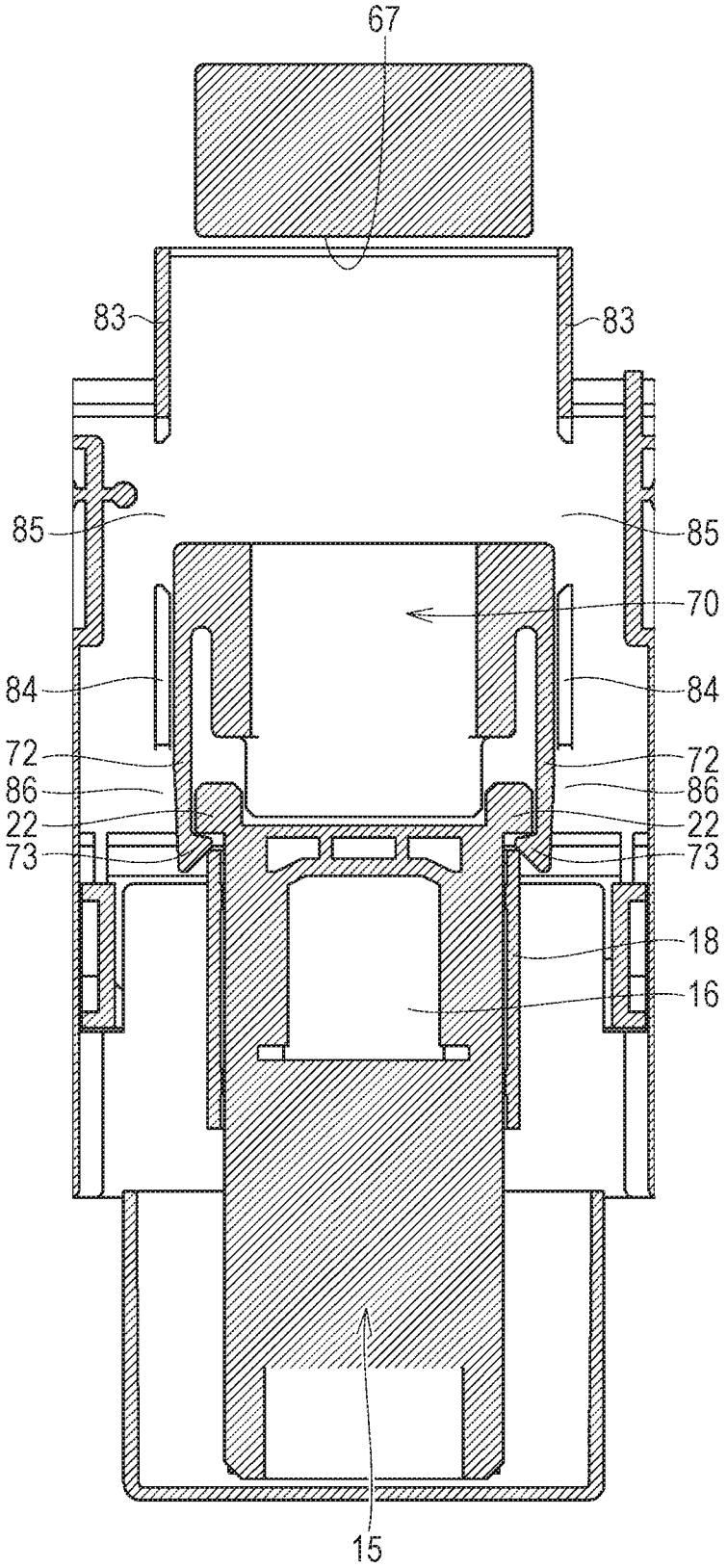
FIG. 16 is a cross-sectional view of the toner supply device, illustrating a second step of the detachment operation.
Figure 17:
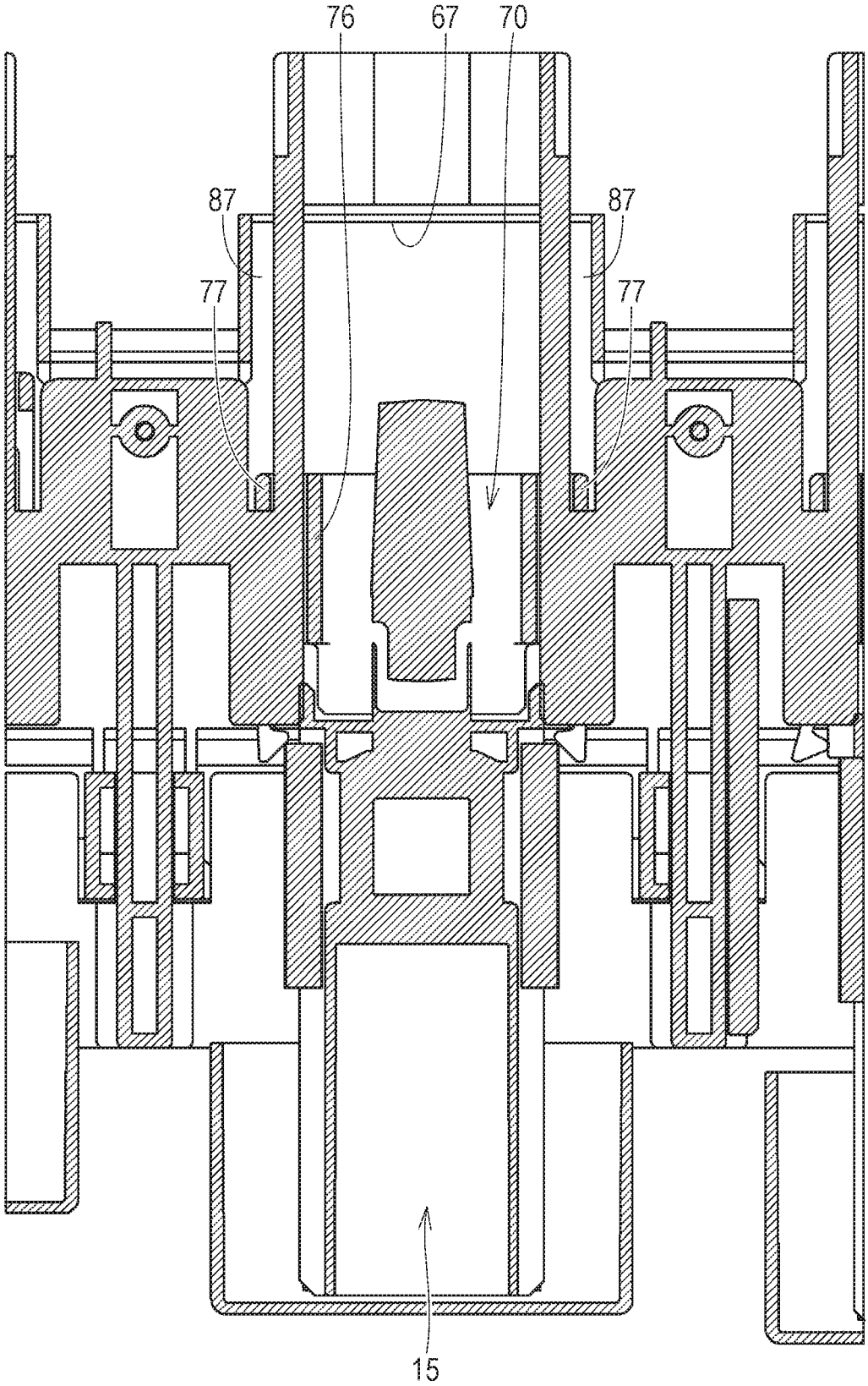
FIG. 17 is a cross-sectional view of the toner supply device different from FIG. 16, illustrating the second step of the detachment operation.

FIG. 16 is a cross-sectional view of the toner supply device, illustrating a second step of the detachment operation. FIG. 17 is a cross-sectional view of the toner supply device different from FIG. 16, illustrating the second step of the detachment operation. As illustrated in FIG. 17, a guide groove 87 extending in the front-rear direction is formed in the device body 61. Each protrusion 77 of the shutter 70 is moved along the guide groove 87. The protrusion 77 is guided by the guide groove 87 and moved in the front-rear direction.

When the shutter 70 in moved in the front direction integrally with the toner bottle 15, each protrusion 77 abuts on a front end of the guide groove 87, thereby hindering movement of the shutter 70 as illustrated in FIG. 17. At this time, the shutter body 71 of the shutter 70 is moved up to the shielding position to shield the toner supply port 26 as illustrated in FIG. 16.

Figure 18:
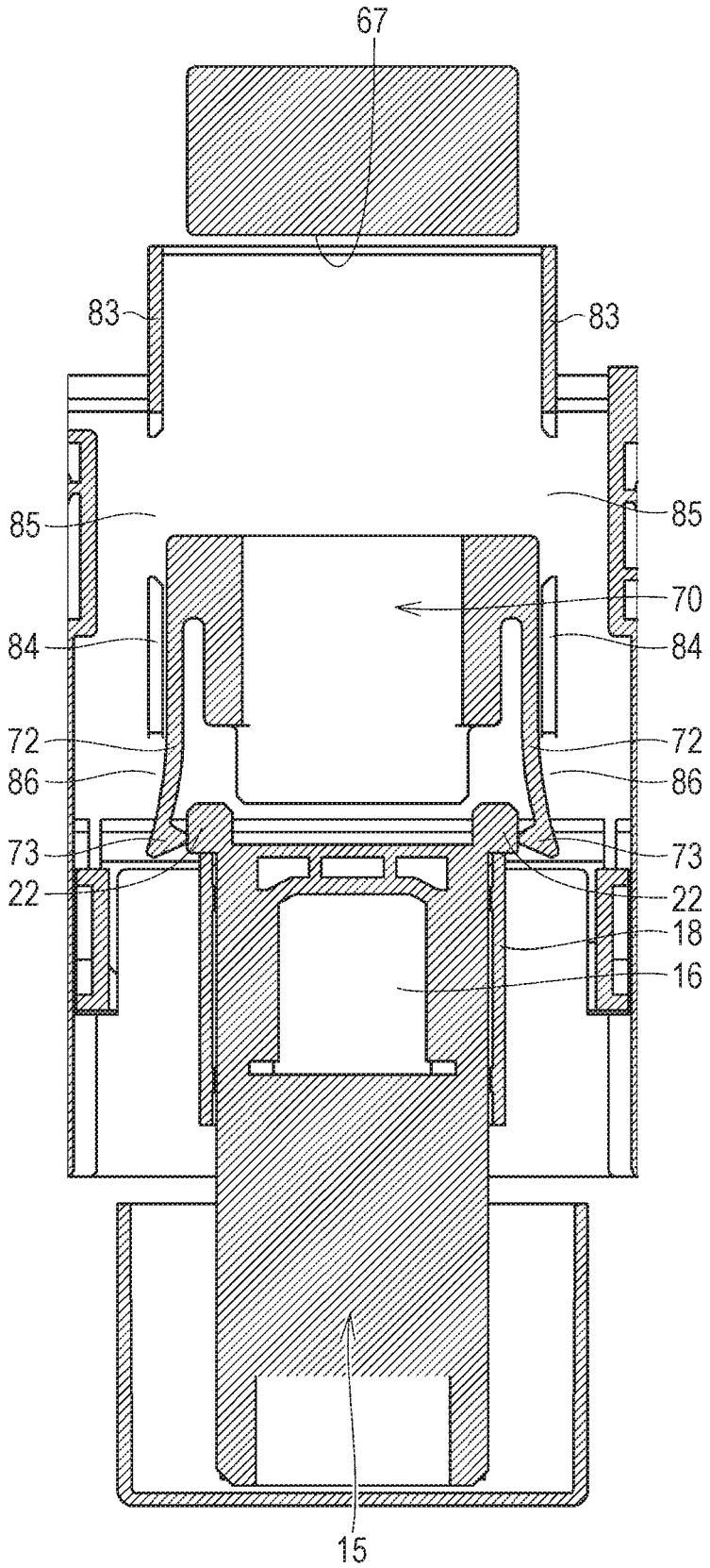
FIG. 18 is a cross-sectional view of the toner supply device, illustrating a third step of the detachment operation.

FIG. 18 is a cross-sectional view of the toner supply device, illustrating a third step of the detachment operation. Each protrusion 77 abuts on the front end of the guide groove 87 and hinders the movement of the shutter 70, whereas movement of the toner bottle 15 in the front direction is continued. Each engagement surface 25 of the toner bottle 15 slides on the engagement surface 75 of each engagement part 73 of the shutter 70. At this time, the arms 72 are elastically deformed such that the pair of engagement parts 73 is moved in the directions away from the shutter body 71.

In the position illustrated in FIG. 18, each engagement part 73 is set at the same position as each relief part 86 in the front-rear direction. Each engagement part 73 is set on the more front side than each guide rail 84 in the front-rear direction, and set at a position not overlapping with the guide rails 83 and 84 in the front-rear direction. Movement of each engagement part 73 in the direction away from the shutter body 71 is not hindered by the guide rails 83 and 84, and movement of each engagement part 73 in the direction away from the shutter body 71 is allowed.

The toner bottle 15 is continuously relatively moved with respect to the shutter 70 that is stopped to be moved in the front direction. When each engagement part 22 of the toner bottle 15 is moved to the more front side than each engagement part 73 of the shutter 70, the engagement part 22 and the engagement part 73 are disengaged from each other. Since the stress which the engagement part 22 acts on the engagement part 73 is released, elastic deformation of each arm 72 is released and the shape of each arm 72 returns to the original shape. Each arm 72 returns to the shape extending in the front-rear direction.

The shutter 18 illustrated in FIG. 18 is set at a position to completely close the toner supply port 16 of the toner bottle 15. After the shutter 18 closes the toner supply port 16, the regulating part 81 is moved below the opening 21. The regulating part 81 is set at a position not hindering the movement of the shutter 18. With this movement of the regulating part 81, the shutter 18 can be moved together with the toner bottle 15.

The body of the toner bottle 15 and the shutter 18 are integrally moved to the outside of the device body 61, thereby detaching the entire toner bottle 15 from the device body 61.

Thus, the toner bottle 15 is moved in the front direction in the state in which each engagement part 22 of the toner bottle 15 is engaged with each engagement part 73 of the shutter 70 as illustrated in FIGS. 15 and 16. Consequently, the shutter 70 is moved from the open position to the shielding position and the toner supply port 26 can be shielded. Since engagement between each engagement part 22 and each engagement part 73 is disengaged after moving the shutter 70 to the shielding position as illustrated in FIG. 18, the toner bottle 15 can be detached from the device body 61.

As illustrated in FIG. 18, the guide rail 84 allows movement of each engagement parts 73 in the direction intersecting with the front-rear direction when the shutter 70 is located at the shielding position. Consequently, engagement between each engagement part 22 and each engagement part 73 is disengaged by moving the engagement part 73 in the intersecting direction after moving the shutter 70 to the shielding position, and the toner bottle 15 can be surely detached.

As illustrated in FIG. 17, the guide grooves 87 are formed in the device body 61. When each protrusion 77 of the shutter 70 abuts on a front end of the guide groove 87, it is possible to surely adjust the position of the shutter 70 to the shielding position.

Although embodiments of the present invention have been described and illustrated in detail, the disclosed embodiments are made for purposes of illustration and example only and not limitation. The scope of the present invention should be interpreted by terms of the appended claims.

What is claimed is:

1. A toner supply device comprising:

a device body; and a toner bottle that is attachable to and detachable from the device body, wherein:

a toner supply port through which toner to be supplied to the device body from the toner bottle passes is formed in each of the device body and the toner bottle, one of the device body and the toner bottle includes: a shutter that is movable between a shielding position to shield the toner supply port and an open position to open the toner supply port; and a first engagement part that is movable in conjunction with the shutter, the other one of the device body and the toner bottle includes a second engagement part that is engagable with the first engagement part, each of the first and second engagement parts comprises an inclined surface extending in a direction inclined with respect to a movement direction of the toner bottle when the toner bottle is being attached to or detached from the device body, during an attachment operation to attach the toner bottle to the device body, the shutter moves from the shielding position to the open position and opens the toner supply port by moving the second engagement part while the second engagement part abuts on the first engagement part, and then the first engagement part engages the second engagement part in an integrally movable manner, and during a detachment operation to detach the toner bottle from the device body, the shutter moves from the open position to the shielding position and closes the toner supply port in a state in which the first engagement part and the second engagement part are engaged with each other, and then the first engagement part and the second engagement part is disengaged.

2. The toner supply device according to claim 1, wherein the second engagement part abuts on the inclined surface of the first engagement part during the attachment operation.

3. The toner supply device according to claim 1, further comprising a plurality of additional first engagement parts.

4. The toner supply device according to claim 1, further comprising an abutment part on which the shutter that has been moved to the open position abuts.

5. The toner supply device according to claim 1, wherein:

a state between the first engagement part and the second engagement part is switched between engagement and disengagement by moving the first engagement part in a direction intersecting with the movement direction of the toner bottle to be attached to or detached from the device body, and while the shutter is being moved from the shielding position to the open position, the first engagement part is not moved in an intersecting direction during the attachment operation.

6. The toner supply device according to claim 5, wherein the first engagement part is moved in the intersecting direction after the shutter reaches the open position.

7. The toner supply device according to claim 5, further comprising a regulating member that hinders movement in the intersecting direction of the first engagement part while the shutter is being moved from the shielding position to the open position.

8. The toner supply device according to claim 7, wherein the regulating member allows movement in the intersecting direction of the first engagement part when the shutter is located at the open position.

9. An image forming apparatus comprising:

an image carrier;

a developing device that develops a toner image on the image carrier; and the toner supply device according to claim 1, which supplies toner to the developing device.

* * * * *